US007832995B2

(12) United States Patent
Yamamuro et al.

(10) Patent No.: US 7,832,995 B2
(45) Date of Patent: Nov. 16, 2010

(54) VARIABLE DISPLACEMENT VANE PUMP AND METHOD OF MANUFACTURING THE SAME

(75) Inventors: Shigeaki Yamamuro, Zushi (JP); Tadahiko Nogami, Mito (JP)

(73) Assignee: Hitachi, Ltd., Tokyo (JP)

( * ) Notice: Subject to any disclaimer, the term of this patent is extended or adjusted under 35 U.S.C. 154(b) by 544 days.

(21) Appl. No.: 11/976,313

(22) Filed: Oct. 23, 2007

(65) Prior Publication Data

US 2008/0118381 A1 May 22, 2008

(30) Foreign Application Priority Data

Nov. 1, 2006 (JP) ..... 2006-297273

(51) Int. Cl.
*F03C 2/00* (2006.01)
*F04C 2/344* (2006.01)

(52) U.S. Cl. ..... 418/31; 418/30; 417/220; 29/888.025

(58) Field of Classification Search ..... 418/31, 418/30, 1; 417/220, 219, 410.3; 29/888.02, 29/888.025
See application file for complete search history.

(56) References Cited

U.S. PATENT DOCUMENTS 6,382,925 B1 * 5/2002 Oba et al. ..... 417/220
6,976,830 B2 * 12/2005 Uchino ..... 418/30
7,128,542 B2 * 10/2006 Suzuki et al. ..... 418/30

FOREIGN PATENT DOCUMENTS

JP 7-119648 A 5/1995

* cited by examiner

*Primary Examiner*—Thomas E Denion
*Assistant Examiner*—Mary A Davis
(74) *Attorney, Agent, or Firm*—Foley & Lardner LLP

(57) ABSTRACT

A variable displacement vane pump includes a first body, a second body, an adapter ring, a cam ring, and a rotor. The first body includes a cylinder portion, and a base portion covering a first longitudinal end of an inner space of the cylinder portion. The second body covers a second longitudinal end of the inner space of the first body. The adapter ring has an outer radial periphery fitted and fixed to an inner radial periphery of the cylinder portion of the first body. The cam ring is mounted inside the adapter ring and supported by the adapter ring for lateral motion in contact with the contact area of the adapter ring. The rotor is mounted inside the cam ring. The adapter ring has a radial thickness that gradually increases when followed longitudinally of the adapter ring from the base portion of the first body toward the second body.

22 Claims, 11 Drawing Sheets

VARIABLE DISPLACEMENT VANE PUMP AND METHOD OF MANUFACTURING THE SAME

BACKGROUND OF THE INVENTION

The present invention relates generally to variable displacement pumps, and more particularly to variable displacement vane pumps useful for automotive continuously variable transmissions and automotive power steering systems.

Japanese Patent Application Publication No. 7-119648 discloses a variable displacement vane pump for an automotive power steering system. This variable displacement vane pump generally includes a pump body, an adapter ring, a cam ring, a rotor, and a pressure plate. The pump body includes a front body and a rear body which are coupled to form a chamber therebetween. Specifically, the front body includes a cylinder portion having an inner space extending longitudinally therethrough, and a base portion covering a first longitudinal end of the inner space of the cylinder portion, while the rear body covers a second longitudinal end of the inner space of the front body. The adapter ring is mounted in the inner space of the pump body, and fitted and fixed to the inner radial periphery of the front body, defining an elliptical space inside. The cam ring is mounted in the elliptical space for moving laterally leftward and rightward. The rotor is mounted inside the cam ring, and fixed to a drive shaft extending through the front body of the pump body. The pressure plate is disposed between the rotor and the base portion of the front body, and in sliding contact with one longitudinal end surface of the rotor. The rotor includes a plurality of slots arranged circumferentially at the outer radial periphery, the slots extending radially of the rotor. A plurality of vanes are mounted in respective ones of the slots for moving longitudinally thereof. The vanes separate the space defined between the rotor and the cam ring, defining a plurality of pump chambers. The space defined between the cam ring and the rotor includes a first region in which each pump chamber gradually expands with rotation of the rotor, and a second region in which each pump chamber gradually contracts with rotation of the rotor. A suction port is formed in one longitudinal end surface of the rear body so as to face the first region, while a discharge port is formed in one longitudinal end surface of the pressure plate so as to face the second region. A pressure relief groove is defined in a portion of the inner radial periphery of the cam ring between the first region and the second region for allowing the working fluid to flow between two adjacent pump chambers. This is intended for allowing the working fluid to flow from the pump chamber in the second region to the pump chamber in the first region, preventing the internal pressure of the pump chamber from rapidly changing when the pump chamber moves from the first region to the second region, and thereby reducing fluctuations in the discharge pressure of the variable displacement vane pump.

SUMMARY OF THE INVENTION

When a variable displacement vane pump is employed in an automotive vehicle, it is desired to reduce the weight and size of the variable displacement vane pump while increasing the output of the variable displacement vane pump. In order to provide a maximized internal space with a minimized size, the pump body is made of a light material such as an aluminum alloy, and the thickness of the walls of the pump body is minimized, for example. In such a case, there is a possibility that when the internal pressure of the pump chambers are high in the second region of the space defined between the rotor and the cam ring in which the discharge port is formed, the cylinder portion of the front body is deformed radially outside so that the inner radial surface of the cylinder portion is inclined. The inclination of the inner radial surface of the cylinder portion of the front body, which is significant especially in a portion of the cylinder portion radially outside of the second region, results in inclination of the longitudinal axes of the adapter ring and the cam ring. The inclination of the inner radial peripheral surface of the cam ring causes inclination of the vanes, because the outer edge of each vane remains in edge-to-surface contact with the inner peripheral surface of the cam ring. On the other hand, the rotor is in position with no inclination, because the rotor is fixed to the drive shaft. Accordingly, each vane extends longitudinally of the drive shaft outside the rotor. As a result, there is a possibility that each vane contacts or interferes at its corner with the longitudinal end surface of the rear body and the longitudinal end surface of the pressure plate. This may cause unbalanced wear and seizing due to friction on the longitudinal end surface of the rear body and the longitudinal end surface of the pressure plate.

Accordingly, it is desirable to provide a variable displacement vane pump wherein deformation of the front body due to the discharge pressure is suitably cancelled.

According to one aspect of the present invention, a variable displacement vane pump comprises: a first body including: a cylinder portion having an inner space extending longitudinally therethrough; and a base portion covering a first longitudinal end of the inner space of the cylinder portion; a second body covering a second longitudinal end of the inner space of the first body; a drive shaft supported by the first body and the second body for rotation, the drive shaft having a longitudinal axis extending in the inner space of the first body longitudinally of the cylinder portion of the first body; an adapter ring having an outer radial periphery fitted and fixed to an inner radial periphery of the cylinder portion of the first body, and having an inner radial periphery including a contact area; a cam ring mounted inside the adapter ring and supported by the adapter ring for lateral motion in contact with the contact area of the adapter ring, the cam ring and the adapter ring defining first and second fluid pressure chambers therebetween, the first fluid pressure chamber having a volumetric capacity that increases when the cam ring moves toward a first end position, the second fluid pressure chamber having a volumetric capacity that increases when the cam ring moves toward a second end position; a rotor mounted inside the cam ring and coupled to the drive shaft at least for rotation about an axis in a direction, the rotor defining an annular chamber outside thereof, the rotor including a plurality of slots arranged circumferentially at its outer radial periphery, each of the slots extending radially of the rotor; a plurality of vanes mounted in respective ones of the slots of the rotor for moving longitudinally of the slots of the rotor, the vanes extending radially of the rotor and dividing the annular chamber into a plurality of pump chambers; a suction port defined in a first section of the annular chamber in which each of the pump chambers expands with the rotation of the rotor; and a discharge port defined in a second section of the annular chamber in which each of the pump chambers contracts with the rotation of the rotor, the discharge port defining a third section of the annular chamber from the suction port to the discharge port along the direction of rotation of the rotor, the third section having a larger volumetric capacity when the cam ring is in the second end position than when the cam ring is in the first end position, wherein the adapter ring has at least in the contact area a radial thickness that gradually increases when followed longitudinally of the adapter ring from the base portion of the first body toward the second body.

According to another aspect of the invention, a variable displacement vane pump comprises: a first body including: a cylinder portion having an inner space extending longitudinally therethrough; and a base portion covering a first longitudinal end of the inner space of the cylinder portion; a second body covering a second longitudinal end of the inner space of the first body; a drive shaft supported by the first body and the second body for rotation, the drive shaft having a longitudinal axis extending in the inner space of the first body longitudinally of the cylinder portion of the first body; an adapter ring having an outer radial periphery fitted and fixed to an inner radial periphery of the cylinder portion of the first body; a cam ring support member disposed at an inner radial periphery of the adapter ring; a cam ring mounted inside the adapter ring and supported by the cam ring support member for lateral motion in contact with the cam ring support member, the cam ring and the adapter ring defining first and second fluid pressure chambers therebetween, the first fluid pressure chamber having a volumetric capacity that increases when the cam ring moves toward a first end position, the second fluid pressure chamber having a volumetric capacity that increases when the cam ring moves toward a second end position; a rotor mounted inside the cam ring and coupled to the drive shaft at least for rotation about an axis in a direction, the rotor defining an annular chamber outside thereof, the rotor including a plurality of slots arranged circumferentially at its outer radial periphery, each of the slots extending radially of the rotor; a plurality of vanes mounted in respective ones of the slots of the rotor for moving longitudinally of the slots of the rotor, the vanes extending radially of the rotor and dividing the annular chamber into a plurality of pump chambers; a suction port defined in a first section of the annular chamber in which each of the pump chambers expands with the rotation of the rotor; and a discharge port defined in a second section of the annular chamber in which each of the pump chambers contracts with the rotation of the rotor, the discharge port defining a third section of the annular chamber from the suction port to the discharge port along the direction of rotation of the rotor, the third section having a larger volumetric capacity when the cam ring is in the second end position than when the cam ring is in the first end position, wherein the cam ring support member has a thickness radially of the drive shaft that gradually increases when followed longitudinally of the drive shaft from the base portion of the first body toward the second body.

According to a further aspect of the invention, a variable displacement vane pump comprises: a first body including: a cylinder portion having an inner space extending longitudinally therethrough; and a base portion covering a first longitudinal end of the inner space of the cylinder portion; a second body covering a second longitudinal end of the inner space of the first body; a drive shaft supported by the first body and the second body for rotation, the drive shaft having a longitudinal axis extending in the inner space of the first body longitudinally of the cylinder portion of the first body; an adapter ring having an outer radial periphery fitted and fixed to an inner radial periphery of the cylinder portion of the first body, and having an inner radial periphery including a contact area; a cam ring mounted inside the adapter ring and supported by the adapter ring for lateral motion in contact with the contact area of the adapter ring, the cam ring and the adapter ring defining first and second fluid pressure chambers therebetween, the first fluid pressure chamber having a volumetric capacity that increases when the cam ring moves toward a first end position, the second fluid pressure chamber having a volumetric capacity that increases when the cam ring moves toward a second end position; a rotor mounted inside the cam ring and coupled to the drive shaft at least for rotation about an axis in a direction, the rotor defining an annular chamber outside thereof, the rotor including a plurality of slots arranged circumferentially at its outer radial periphery, each of the slots extending radially of the rotor; a plurality of vanes mounted in respective ones of the slots of the rotor for moving longitudinally of the slots of the rotor, the vanes extending radially of the rotor and dividing the annular chamber into a plurality of pump chambers; a suction port defined in a first section of the annular chamber in which each of the pump chambers expands with the rotation of the rotor; and a discharge port defined in a second section of the annular chamber in which each of the pump chambers contracts with the rotation of the rotor, the discharge port defining a third section of the annular chamber from the suction port to the discharge port along the direction of rotation of the rotor, the third section having a larger volumetric capacity when the cam ring is in the second end position than when the cam ring is in the first end position, wherein at least one of the adapter ring and the cam ring has a radial thickness that when followed longitudinally from the base portion of the first body toward the second body, varies in such a manner that when the cylinder portion of the first body is deformed radially outside due to internal pressures of the pump chambers, the cam ring has a surface at its inner radial periphery, the surface facing the discharge port radially of the cam ring and extending substantially parallel to the longitudinal axis of the drive shaft.

According to a still further aspect of the invention, a method of manufacturing a variable displacement vane pump comprising: a first body including: a cylinder portion having an inner space extending longitudinally therethrough; and a base portion covering a first longitudinal end of the inner space of the cylinder portion; a second body covering a second longitudinal end of the inner space of the first body; a drive shaft supported by the first body and the second body for rotation, the drive shaft having a longitudinal axis extending in the inner space of the first body longitudinally of the cylinder portion of the first body; an adapter ring having an outer radial periphery fitted and fixed to an inner radial periphery of the cylinder portion of the first body, and having an inner radial periphery including a contact area; a cam ring mounted inside the adapter ring and supported by the adapter ring for lateral motion in contact with the contact area of the adapter ring, the cam ring and the adapter ring defining first and second fluid pressure chambers therebetween, the first fluid pressure chamber having a volumetric capacity that increases when the cam ring moves toward a first end position, the second fluid pressure chamber having a volumetric capacity that increases when the cam ring moves toward a second end position; a rotor mounted inside the cam ring and coupled to the drive shaft at least for rotation about an axis in a direction, the rotor defining an annular chamber outside thereof, the rotor including a plurality of slots arranged circumferentially at its outer radial periphery, each of the slots extending radially of the rotor; a plurality of vanes mounted in respective ones of the slots of the rotor for moving longitudinally of the slots of the rotor, the vanes extending radially of the rotor and dividing the annular chamber into a plurality of pump chambers; a suction port defined in a first section of the annular chamber in which each of the pump chambers expands with the rotation of the rotor; and a discharge port defined in a second section of the annular chamber in which each of the pump chambers contracts with the rotation of the rotor, the discharge port defining a third section of the annular chamber from the suction port to the discharge port along the direction of rotation of the rotor, the third section having a larger volumetric capacity when the cam ring is in the second end position than when the cam ring is in the first end position, the method comprises: forming the adapter ring in such a manner that the adapter ring includes a tapered portion having a radial thickness that gradually increases when followed longitudinally from a first longitudinal end of the adapter ring to a second longitudinal end of the adapter ring; mounting the adapter ring inside the cylinder portion of the first body in such a manner that the first longitudinal end of the adapter ring faces the base portion of the first body; mounting the drive shaft, the cam ring, and the rotor with the vanes inside the cylinder portion of the first body in such a manner that the tapered portion of the adapter ring radially faces the second section of the annular chamber through the cam ring; and attaching the second body to the first body in such a manner to cover the second longitudinal end of the inner space of the first body.

DETAILED DESCRIPTION OF THE INVENTION

Figure 1:
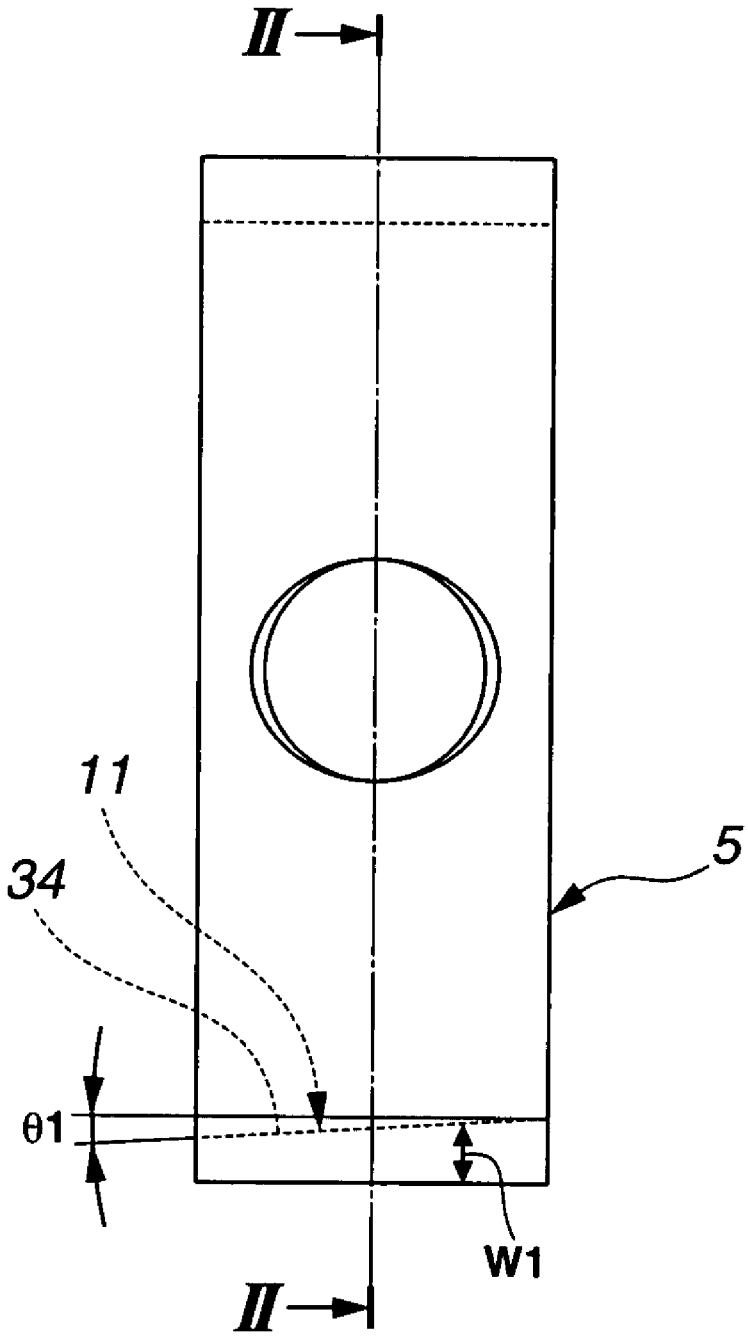
FIG. 1 is a side view of an adapter ring of a variable displacement vane pump according to a first embodiment of the present invention.
Figure 2:
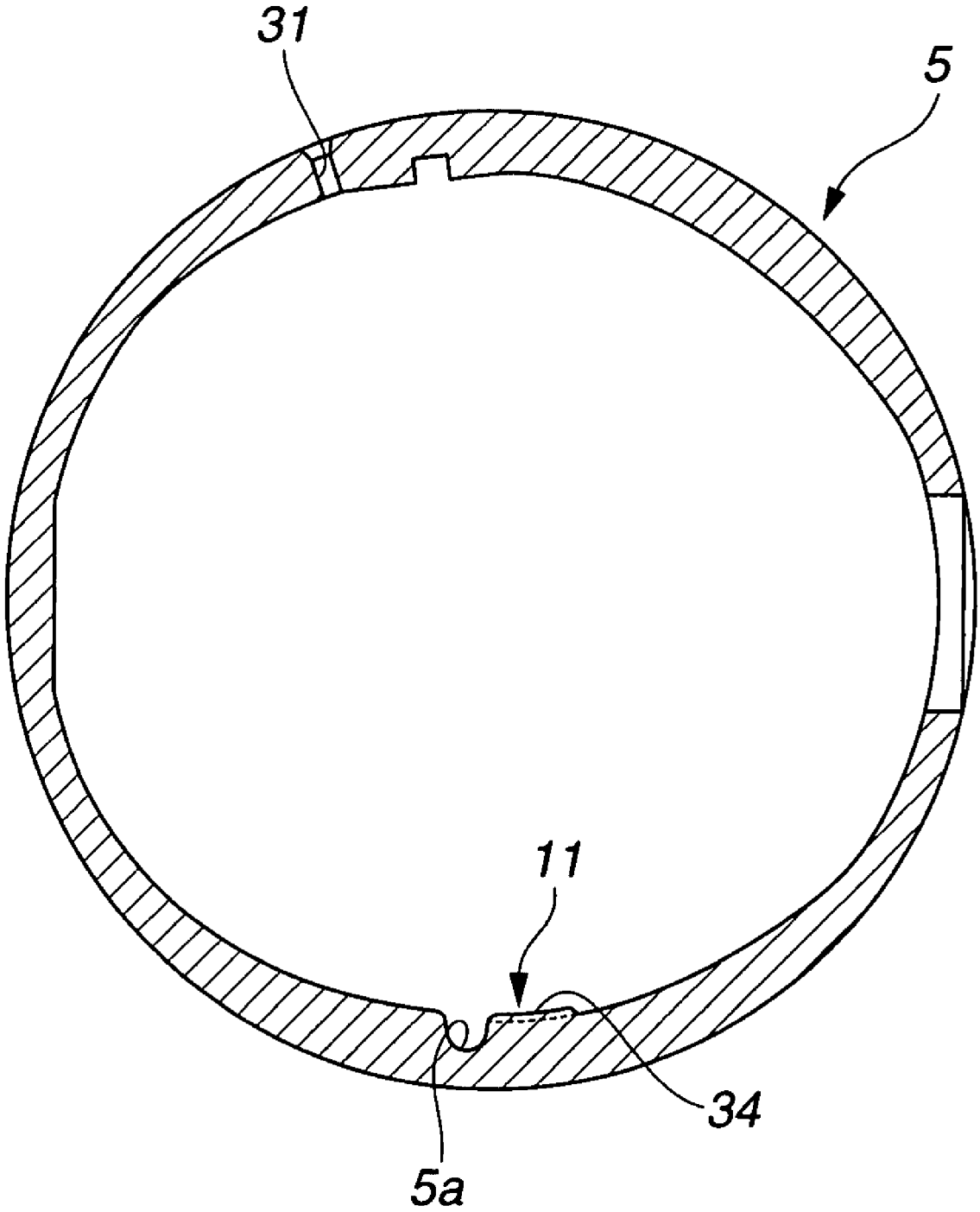
FIG. 2 is a cross-sectional view of the adapter ring according to the first embodiment taken along a plane indicated by the line II-II in FIG. 1.
Figure 3:
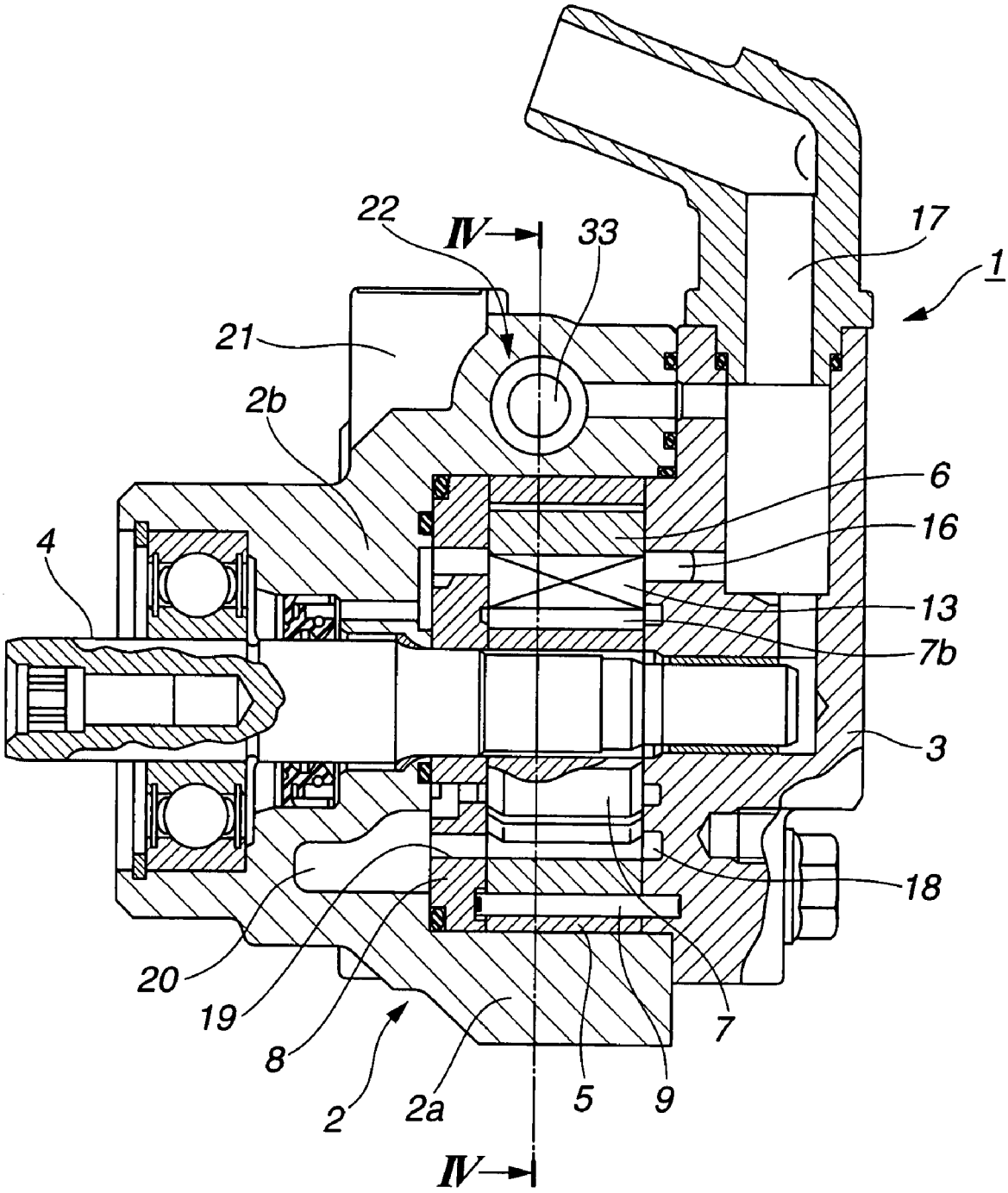
FIG. 3 is a side sectional view of the variable displacement vane pump according to the first embodiment taken along a plane in which a drive shaft has a longitudinal axis.
Figure 4:
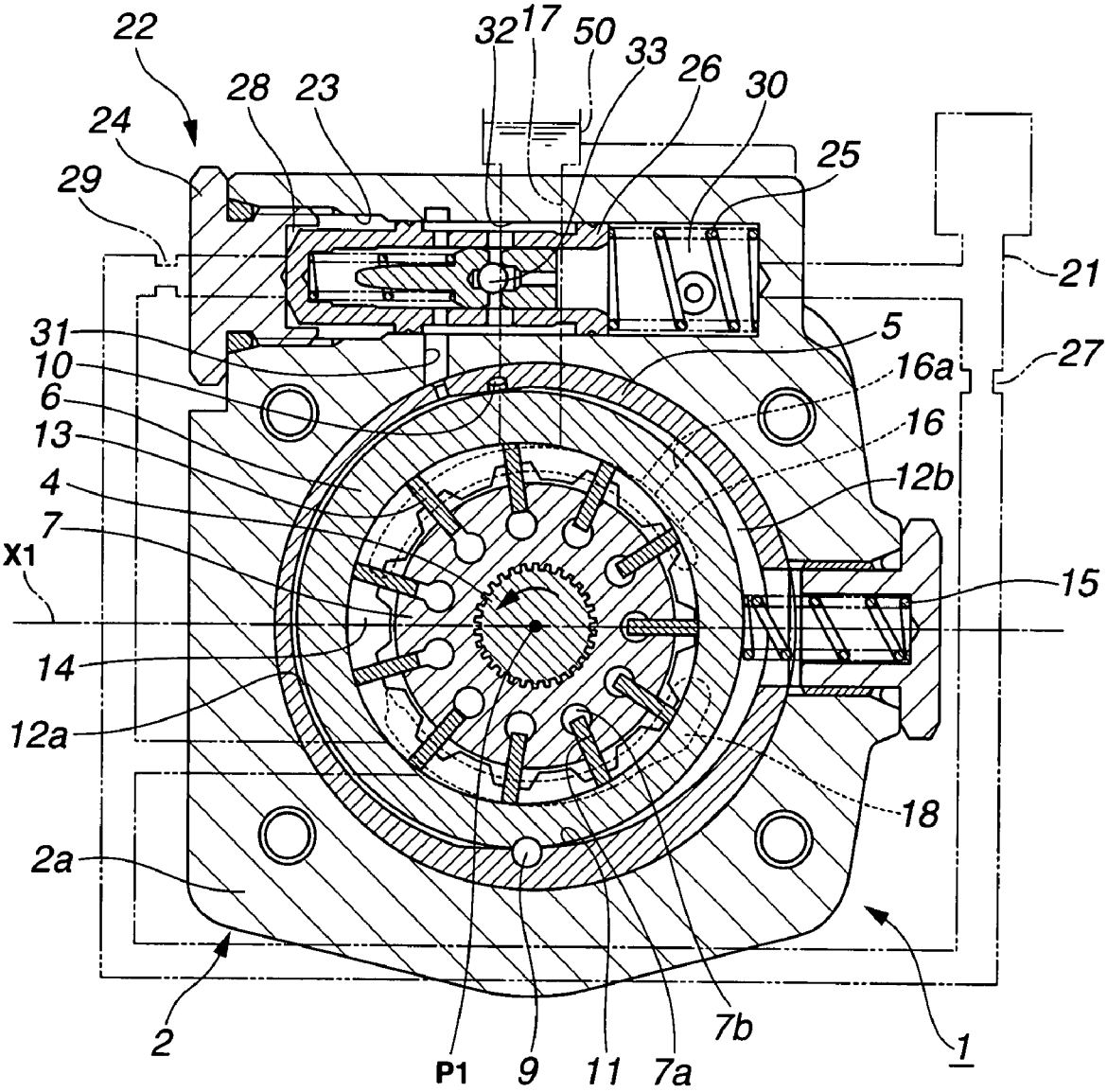
FIG. 4 is a cross-sectional view of the variable displacement vane pump according to the first embodiment taken along a plane indicated by the line IV-IV in FIG. 3.

The following describes a variable displacement vane pump according to a first embodiment of the present invention with reference to FIGS. 1 to 4. This variable displacement vane pump may be employed in an automotive power steering system. For ease of understanding, various directional terms, such as, right, left, upper, lower, rightward and the like are used in the following description. Such terms are to be understood with respect to a drawing or drawings on which corresponding part or portion is shown. As shown in FIGS. 3 and 4, a variable displacement vane pump 1 generally includes a front body 2 as a first body, a rear body 3 as a second body, a drive shaft 4, an adapter ring 5, a cam ring 6, a rotor 7, and a pressure plate 8. Front body 2 is made of a light material such as an aluminum alloy. Front body 2 includes a cylinder portion 2*a* having an inner space extending longitudinally therethrough, and a base portion 2*b* covering a first longitudinal end of the inner space of cylinder portion 2*a*. Rear body 3 is coupled to front body 2 in such a manner to cover or close a second longitudinal end of cylinder portion 2*a*. Extending through base portion 2*b* of front body 2, drive shaft 4 is rotatably supported through a bearing on front body 2 and also rotatably supported through a bearing on rear body 3. Drive shaft 4 has a longitudinal axis extending in the inner space of front body 2 longitudinally of cylinder portion 2*a* of front body 2. Adapter ring 5 is annularly shaped, and has an outer radial periphery fitted and fixed to the inner radial periphery of cylinder portion 2*a* of front body 2. Cam ring 6 is annularly shaped, mounted radially inside the adapter ring 5, and supported by adapter ring 5 for moving laterally leftward and rightward as viewed in FIG. 4. Rotor 7 is mounted radially inside the cam ring 6, and is coupled or fixed to drive shaft 4 for rotation therewith. Pressure plate 8 is disc-shaped, and is retained between base portion 2*b* of front body 2 and one longitudinal end face of adapter ring 5.

Adapter ring 5 is made of a sintered alloy. As shown in FIGS. 2 and 4, adapter ring 5 includes a pin-retaining groove 5*a* at a lower portion of its inner radial periphery. Pin-retaining groove 5*a* has a semicircular cross section, extending longitudinally of adapter ring 5, for retaining a positioning pin 9. Adapter ring 5 includes a contact area referred to as pivoting contact area 11 at its inner radial periphery on the right of pin-retaining groove 5*a* as viewed in FIG. 4. Pivoting contact area 11 of adapter ring 5 is adapted to be in contact with cam ring 6 for allowing the cam ring 6 to move laterally leftward and rightward as viewed in FIG. 4. Pivoting contact area 11 faces a second fluid pressure chamber 12*b* described in detail below.

Positioning pin 9 serves to retain cam ring 6, and prevent cam ring 6 from sliding with respect to adapter ring 5. Cam ring 6 rotates not about positioning pin 9 but about pivoting contact area 11.

Cam ring 6 is made of a bearing metal, and formed by cutting. Cam ring 6 has inner and outer radial peripheries extending substantially parallel to the longitudinal axis of drive shaft 4. As shown in FIG. 4, a seal 10 is disposed radially outside of cam ring 6, and mounted at an upper portion of the inner radial periphery of adapter ring 5. Cam ring 6 cooperates with positioning pin 9 and seal 10 to separate the surrounding space into a first fluid pressure chamber 12*a* on the left side and second fluid pressure chamber 12*b* on the right side as viewed in FIG. 4. First fluid pressure chamber 12*a* has a volumetric capacity that increases when cam ring 6 moves toward a first end position (right end position), while second fluid pressure chamber 12*b* has a volumetric capacity that increases when cam ring 6 moves toward a second end position (left end position). Cam ring 6 is arranged to swing in contact with a specific portion of pivoting contact area 11 of adapter ring 5 in a direction to contract first fluid pressure chamber 12*a* and in a direction to contract second fluid pressure chamber 12*b*.

When an engine not shown drives drive shaft 4 to rotate, rotor 7 rotates counterclockwise as indicated by the curved arrow in FIG. 4. Rotor 7 includes a plurality of slots 7*a* arranged circumferentially and evenly spaced at the outer radial periphery of rotor 7, each of slots 7*a* extending radially of rotor 7. A plurality of vanes 13 are retained in respective ones of slots 7*a* of rotor 7 for moving radially of rotor 7. Each vane 13 is a rectangular plate made of a metal. A back pressure chamber 7*b* is formed integrally with the inner end of each slot 7*a* for receiving a working fluid and pressing the vane 13 outward to the inner radial periphery of cam ring 6. Back pressure chamber 7*b* has a circular section as viewed in FIG. 4.

Two adjacent vanes 13 define a pump chamber 14 in the annular space defined between cam ring 6 and rotor 7. The volumetric capacity of each pump chamber 14 varies with swing motion of cam ring 6.

As shown in FIG. 4, a spring 15 is disposed in second fluid pressure chamber 12*b* and fixed to a bolt-shaped spring retainer for biasing constantly cam ring 6 in the direction to contract first fluid pressure chamber 12*a*.

The annular space defined between cam ring 6 and rotor 7 includes a first region (suction region) in which each pump chamber 14 gradually expands, and a second region (discharge region) in which each pump chamber 14 gradually contracts. As viewed in FIG. 4, the first region is located on the upper side, while the second region is located on the lower side. A suction port 16 is formed in one longitudinal end surface of rear body 3 so as to face the first region. Suction port 16 has an arc-shaped opening. Working fluid is supplied from a reservoir tank 50 through a suction passage 17 and suction port 16 to each pump chamber 14.

On the other hand, discharge ports 18 and 19 are formed in one longitudinal end surface of rear body 3 and one longitudinal end surface of pressure plate 8, respectively, so as to face the second region. Suction port 16 and discharge port 18 defines therebetween a section of the annular chamber defined between rotor 7 and cam ring 6 along the direction of rotation of rotor 7, the section having a larger volumetric capacity when cam ring 6 is in the left end position than when cam ring 6 is in the right end position. Discharge ports 18 and 19 each have an arc-shaped opening. Working fluid is discharged from each pump chamber 14 through discharge ports 18 and 19 to a discharge pressure chamber 20. Discharge pressure chamber 20 is formed in base portion 2*b* of front body 2. The pressurized working fluid in discharge pressure chamber 20 is supplied through a discharge passage 21 formed in front body 2, and through a pipe set not shown to the power steering system.

As shown in FIGS. 3 and 4, a control valve 22 is mounted in an upper portion of front body 2, having a longitudinal axis extending perpendicularly of the longitudinal axis of drive shaft 4. Control valve 22 generally includes a valve chamber 23, a spool 26, and a valve spring 25. Valve chamber 23 is formed in front body 2, and closed by a plug 24, having a longitudinal axis extending perpendicularly of the longitudinal axis of drive shaft 4. Spool 26 is mounted within valve chamber 23 at least for sliding in the longitudinal direction. Valve spring 25 is mounted on the right of spool 26 in valve chamber 23 so as to bias spool 26 leftward toward plug 24 as viewed in FIG. 4. A high-pressure chamber 28 is defined between spool 26 and plug 24 in valve chamber 23. High-pressure chamber 28 is connected to an upstream portion of discharge passage 21 with respect to a metering orifice 27, so as to receive a fluid pressure within discharge port 18.

As shown in FIG. 4, a second orifice 29 is disposed in discharge passage 21 between metering orifice 27 and high-pressure chamber 28 for reducing the fluid pressure supplied to high-pressure chamber 28, and thereby reducing fluctuations in the fluid pressure.

As shown in FIG. 4, a medium-pressure chamber 30 is defined on the right of spool 26 in valve chamber 23, accommodating the valve spring 25. Medium-pressure chamber 30 is arranged to receive a fluid pressure in a downstream portion of discharge passage 21 with respect to metering orifice 27. When the differential pressure between medium-pressure chamber 30 and high-pressure chamber 28 is higher than a specific reference value, spool 26 travels rightward against the biasing force of valve spring 25 as viewed in FIG. 4.

A low-pressure chamber 32 is defined in an annular recess defined in the outer radial periphery of spool 26, and arranged to receive a low fluid pressure from suction passage 17 through an intermediate fluid passage not shown. When spool 26 is displaced leftward as viewed in FIG. 4, first fluid pressure chamber 12*a* is connected to low-pressure chamber 32 through a fluid passage 31 so as to receive a low fluid pressure. On the other hand, when spool 26 is displaced rightward due to the differential pressure, first fluid pressure chamber 12*a* is connected to high-pressure chamber 28 so as to receive a high fluid pressure.

On the other hand, second fluid pressure chamber 12*b* is connected through suction port 16 and a fluid communication groove 16*a* to suction passage 17 so as to receive constantly a low fluid pressure from the suction side. Fluid communication groove 16*a* is connected between suction port 16 and second fluid pressure chamber 12*b*, and defined in the inside longitudinal end surface of rear body 3 to extend radially outside of a portion of suction port 16 near second fluid pressure chamber 12*b*.

A relief valve 33 is mounted in a center bore of spool 26 of control valve 22 for allowing fluid communication between the medium-pressure chamber 30 and low-pressure chamber 32 when the internal pressure of medium-pressure chamber 30 is higher than a specific threshold value.

In FIG. 4, a reference plane X1 is defined by a line connecting an axis of rotation P1 of drive shaft 4 and a midpoint between the end point of suction port 16 and the start point of discharge port 18. Pivoting contact area 11 of adapter ring 5 is defined in a specific portion extending from a point facing the second fluid pressure chamber 12*b* to positioning pin 9 as viewed in FIG. 4. When followed from that point to positioning pin 9, pivoting contact area 11 extends away from reference plane X1.

A radial thickness W1 is defined as a radial thickness of adapter ring 5 at pivoting contact area 11 as shown in FIG. 1. As shown in FIGS. 1 and 2, radial thickness W1 increases gradually and linearly, when followed longitudinally of adapter ring 5 from the longitudinal end in contact with pressure plate 8 to the longitudinal end in contact with rear body 3. In other words, pivoting contact area 11 is implemented by an inclined surface 34 which is inclined by an angle of inclination θ1 with respect to the longitudinal axis of adapter ring 5. The angle of inclination θ1 is equal to about 0.08°. Thus, adapter ring 5 has only in pivoting contact area 11*a* radial thickness that gradually increases when followed longitudinally of adapter ring 5 from pressure plate 8 toward rear body 3, while adapter ring 5 has except in pivoting contact area 11*a* radial thickness that is substantially constant when followed longitudinally of adapter ring 5 from pressure plate 8 toward rear body 3.

The following describes a method of manufacturing the variable displacement vane pump described above, with reference to FIGS. 3 and 4. Generally, the method includes: forming the adapter ring in such a manner that the adapter ring includes a tapered portion having a radial thickness that gradually increases when followed longitudinally from a first longitudinal end of the adapter ring to a second longitudinal end of the adapter ring; mounting the adapter ring inside the cylinder portion of the first body in such a manner that the first longitudinal end of the adapter ring faces the base portion of the first body; mounting the drive shaft, the cam ring, and the rotor with the vanes inside the cylinder portion of the first body in such a manner that the tapered portion of the adapter ring radially faces the second section of the annular chamber through the cam ring; and attaching the second body to the first body in such a manner to cover the second longitudinal end of the inner space of the first body. The method further includes: forming the cam ring in such a manner that the cam ring includes a tapered portion having a radial thickness that gradually increases when followed longitudinally from a first longitudinal end of the cam ring to a second longitudinal end of the cam ring; and mounting the cam ring inside the adapter ring in such a manner that the tapered portion of the cam ring radially faces the tapered portion of the adapter ring and the second longitudinal end of the cam ring faces the base portion of the first body. More specifically, the method of manufacturing includes an operation of forming the front body 2 by casting an aluminum alloy, and an operation of mounting the pressure plate 8 to inside the cylinder portion 2*a* of front body 2 in such a manner that pressure plate 8 is in surface-to-surface contact with base portion 2*b* of front body 2. The method further includes an operation of forming the adapter ring 5 by sintering, i.e. by using metal particles to form a desired shape and heat-treating it below the melting point, and an operation of mounting the seal 10 and positioning pin 9 to adapter ring 5, and then mounting the adapter ring 5 to inside the cylinder portion 2*a* of front body 2 in such a manner that adapter ring 5 is in surface-to-surface contact with pressure plate 8, and the longitudinal end of adapter ring 5 where radial thickness W1 at pivoting contact area 11 is smaller faces the pressure plate 8. The method further includes an operation of forming the cam ring 6 by cutting a cylindrical bearing metal, and an operation of mounting the cam ring 6 inside the adapter ring 5. The method further includes an operation of coupling the drive shaft 4 to rotor 7 with vanes 13 mounted in slots 7*a,* to construct an assembly, and then mounting this assembly to inside the cam ring 6 inside the cylinder portion 2*a* of front body 2 in such a manner that the longitudinal position of rotor 7 is substantially identical to that of cam ring 6. The method further includes an operation of coupling the rear body 3 to front body 2 in such a manner that rear body 3 closes the opening of cylinder portion 2*a* of front body 2, and an operation of mounting the spring 15 and the spring retainer to front body 2. Variable displacement vane pump 1 is thus assembled.

The following describes operations and advantageous effects of the variable displacement vane pump according to the first embodiment with reference to FIGS. 3 and 4.

When variable displacement vane pump 1 is operating, the internal pressure of each pump chamber 14 in the discharge region is increased. Especially under operating conditions of high speed, the working fluid in each pump chamber 14 in the discharge region applies a relatively high pressure on the inner radial periphery of cam ring 6, the outer radial periphery of rotor 7, and the lateral surface of the related vanes 13. Rotor 7 is fixed to drive shaft 4 which is solidly supported at one point to front body 2 and at another point to rear body 3. Accordingly, even when the outer radial periphery of rotor 7 is subject to radial fluid pressures, the geometrical position of rotor 7 is substantially unchanged by the fluid pressures. Each vane 13 is subject to a first fluid pressure from one of the related pump chambers 14, and also subject to a second fluid pressure from the other of the related pump chambers 14. These two fluid pressures are cancelled by each other so that the geometrical position of each vane 13 is substantially unchanged by the fluid pressures. On the other hand, when variable displacement vane pump 1 is operating, cam ring 6 is biased to pivoting contact area 11 of adapter ring 5 by the fluid pressure of pump chambers 14. This biasing force applied to cam ring 6 is effective for pressing the cam ring 6 along with adapter ring 5 outward in the radial direction, and thereby biasing the cylinder portion 2*a* of front body 2 outward in the radial direction. Thus, a portion of cylinder portion 2*a* of front body 2 at or near pivoting contact area 11 is slightly elastically deformed outward in the radial direction (downward as viewed in FIGS. 1 to 4), and thereby the inner peripheral surface of the portion of cylinder portion 2*a* is inclined outwardly at about 0.08° to decline gradually and linearly when followed toward rear body 3. Accordingly, the inner radial peripheral surface of adapter ring 5 is relatively inclined toward rear body 3.

However, according to the first embodiment, pivoting contact area 11 of adapter ring 5 is implemented by inclined surface 34 which is inclined toward pressure plate 8 to decline gradually and linearly when followed along the longitudinal direction of adapter ring 5, as described above. Therefore, the deformation of cylinder portion 2*a* of front body 2 is cancelled by the inclination of inclined surface 34 so that cam ring 6 is supported on pivoting contact area 11 of adapter ring 5 with the longitudinal axis being parallel to the longitudinal axis of drive shaft 4. On the other hand, each vane 13 extends perpendicularly of the inner radial peripheral surface of cam ring 6. Thus, vane 13 extends perpendicularly of the longitudinal axis of drive shaft 4. This is effective for preventing the vanes 13 from diagonally extending from slot 7*a* of rotor 7 outside of rotor 7 in the longitudinal direction of rotor 7. As a result, this is effective for suppressing interference between vane 13 and the inside longitudinal end surface of rear body 3 and between vane 13 and the inside longitudinal end surface of pressure plate 8, and thereby preventing unbalanced wear and seizing on rear body 3 and pressure plate 8.

Moreover, according to the first embodiment, adapter ring 5 can be normally shaped in general, because adapter ring 5 includes no inclined surface at the inner radial periphery except the pivoting contact area 11. Although inclined surface 34 is formed locally at pivoting contact area 11, adapter ring 5 can be easily formed, because adapter ring 5 is formed by sintering.

Still moreover, according to the first embodiment, cam ring 6 is sufficiently resistant to pressure and wear, because cam ring 6 is made of a bearing metal and formed by cutting. Cam ring 6 can be easily formed by cutting, because the inner and outer radial peripheral surfaces of cam ring 6 are parallel to each other longitudinally of cam ring 6.

Figure 5:
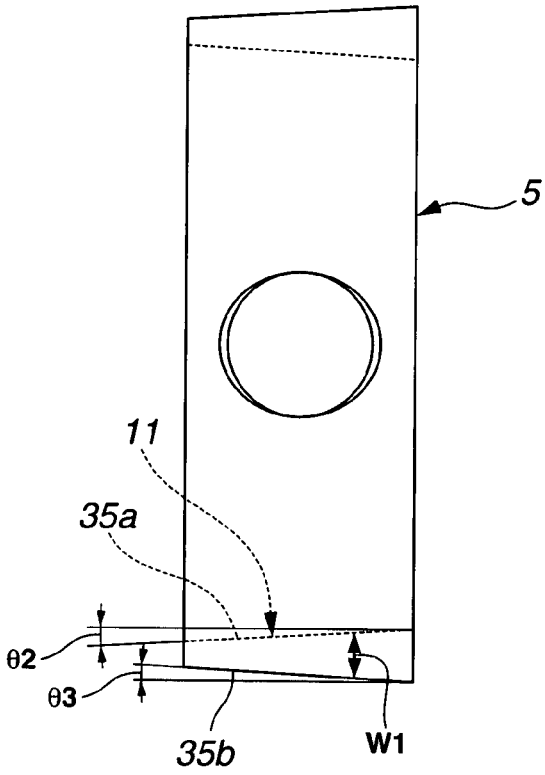
FIG. 5 is a side view of an adapter ring of a variable displacement vane pump according to a second embodiment of the present invention.

The following describes a variable displacement vane pump according to a second embodiment of the present invention with reference to FIG. 5. The second embodiment is constructed based on the first embodiment, and different from the first embodiment in that both of the inner and outer radial peripheries of adapter ring 5 are entirely implemented by inclined surfaces like inclined surface 34 as follows.

Specifically, the inner radial periphery of adapter ring 5 is entirely implemented by an inner inclined surface 35*a* with an angle of inclination θ2, where inner inclined surface 35*a* extends all around the inner radial periphery. On the other hand, the outer radial periphery of adapter ring 5 is entirely implemented by an outer inclined surface 35*b* with an angle of inclination θ3, where outer inclined surface 35*b* extends all around the outer radial periphery. As in the first embodiment, radial thickness W1 at pivoting contact area 11 of adapter ring 5 increases gradually and linearly when followed from the longitudinal end in contact with pressure plate 8 to the longitudinal end in contact with rear body 3. The angle of inclination θ2 and angle of inclination θ3 are set in such a manner that when a portion of cylinder portion 2*a* of front body 2 radially outside of the discharge region is elastically deformed outwardly so that adapter ring 5 is inclined toward rear body 3 at about 0.08°, the inner radial peripheral surface of adapter ring 5 (pivoting contact area 11) and the longitudinal axis of drive shaft 4 are substantially parallel to each other.

According to the second embodiment, adapter ring 5 can be easily formed by sintering, because the provision of inner and outer inclined surfaces 35*a* and 35*b* is effective for making it easy to draw the adapter ring 5 from the sintering mold.

One of the angle of inclination θ2 and angle of inclination θ3 may be set to be equal to zero. This means that inner inclined surface 35*a* is provided and no outer inclined surface 35*b* is provided, or that no inner inclined surface 35*a* is provided and outer inclined surface 35*b* is provided. In such a case, the other of the angle of inclination θ2 and angle of inclination θ3 is set to be equal to about 0.08°, similarly as angle of inclination θ1 of inclined surface 34 according to the first embodiment.

Figure 6:
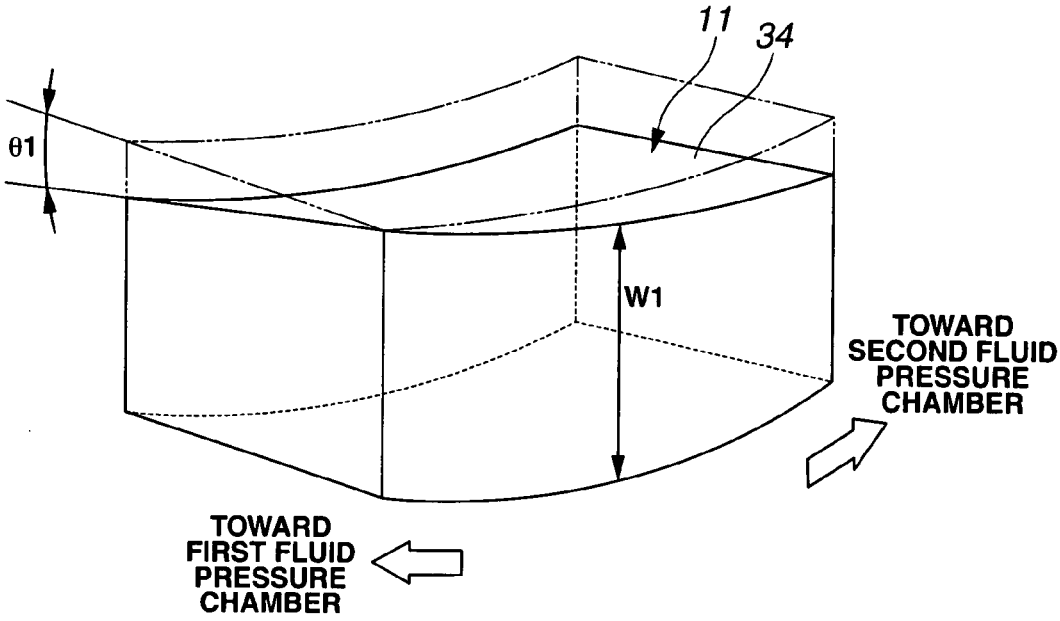
FIG. 6 is a partial perspective view of an adapter ring of a variable displacement vane pump according to a third embodiment of the present invention.

The following describes a variable displacement vane pump according to a third embodiment of the present invention with reference to FIG. 6. The third embodiment is constructed based on the first embodiment, and different from the first embodiment in that radial thickness W1 at pivoting contact area 11 of adapter ring 5 decreases gradually and linearly when followed circumferentially of adapter ring 5 from the side of first fluid pressure chamber 12*a* to the side of second fluid pressure chamber 12*b*. That is, radial thickness W1 in pivoting contact area 11 of adapter ring 5 gradually increases when followed circumferentially of adapter ring 5 from a first portion of pivoting contact area 11 to a second portion of pivoting contact area 11, where cam ring 6 is in contact with the first portion of pivoting contact area 11 when cam ring 6 is in the right end position, and is in contact with the second portion of pivoting contact area 11 when cam ring 6 is in the left end position. In other words, angle of inclination θ1 of inclined surface 34 increases gradually and linearly when followed from the side of second fluid pressure chamber 12*b* to the side of first fluid pressure chamber 12*a*. Pivoting contact area 11 is thus three-dimensionally defined.

The amount of displacement of variable displacement vane pump 1 increases with an increase in displacement or eccentricity of cam ring 6 from its neutral position toward the left side as viewed in FIG. 4. The fluid pressure of each pump chamber 14 in the discharge region increases with an increase in the displacement of cam ring 6 so that the deformation of cylinder portion 2*a* of front body 2 increases. Even when the deformation of cylinder portion 2*a* of front body 2 is large, the deformation of cylinder portion 2*a* is suitably cancelled, because a portion of pivoting contact area 11 of adapter ring 5 near first fluid pressure chamber 12*a* with which cam ring 6 is in contact when the displacement of cam ring 6 is large is implemented by an inclined surface whose angle of inclination θ1 is sufficiently large.

On the other hand, when the amount of displacement of variable displacement vane pump 1 is small, that is, when the displacement of cam ring 6 is small, the fluid pressure of each pump chamber 14 in the discharge region is low so that the deformation of cylinder portion 2*a* of front body 2 is small. The small deformation of cylinder portion 2*a* is suitably cancelled, because a portion of pivoting contact area 11 of adapter ring 5 near second fluid pressure chamber 12*b* with which cam ring 6 is in contact when the displacement of cam ring 6 is small is implemented by an inclined surface whose angle of inclination θ1 is relatively small. The inner radial peripheral surface of cam ring 6 is thus maintained to be substantially parallel to the longitudinal axis of drive shaft 4.

According to the third embodiment, the three-dimensional shape of pivoting contact area 11 of adapter ring 5 is effective for preventing unbalanced wear and seizing of rear body 3 and pressure plate 8, wherever cam ring 6 is positioned or however the pump discharge pressure is set.

In case the variable displacement vane pump according to the third embodiment is exemplified in an automotive power steering system, the variable displacement vane pump is effective, when the steering wheel is turned while the vehicle is at rest or running at low speed, that is, when the displacement of cam ring 6 is relatively large so that the pump discharge pressure is high, and is effective also when the vehicle is running at middle or high speed, that is, when the displacement of cam ring 6 is relatively small so that the pump discharge pressure is low.

Figure 7:
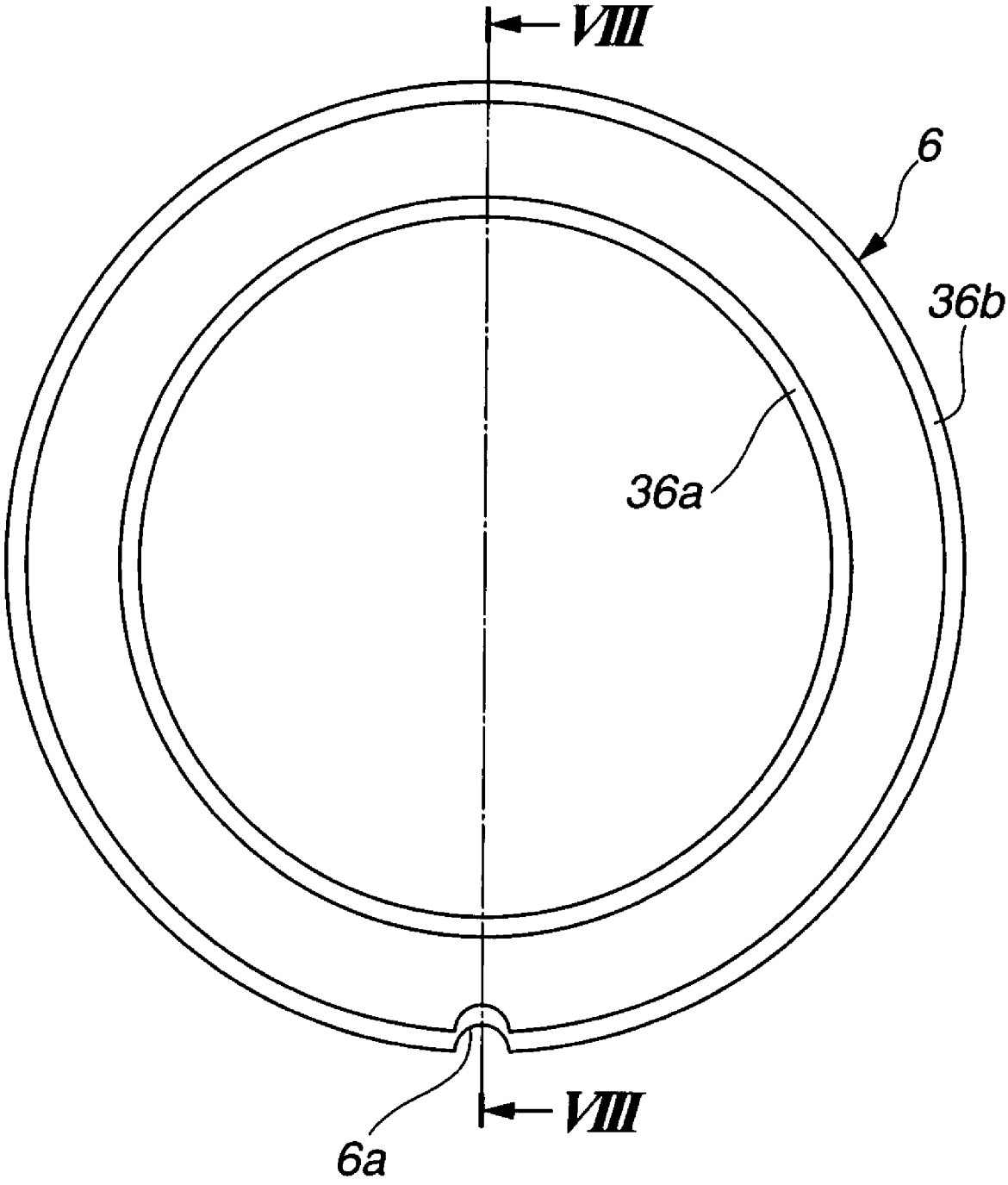
FIG. 7 is a plan view of a cam ring of a variable displacement vane pump according to a fourth embodiment of the present invention.
Figure 8:
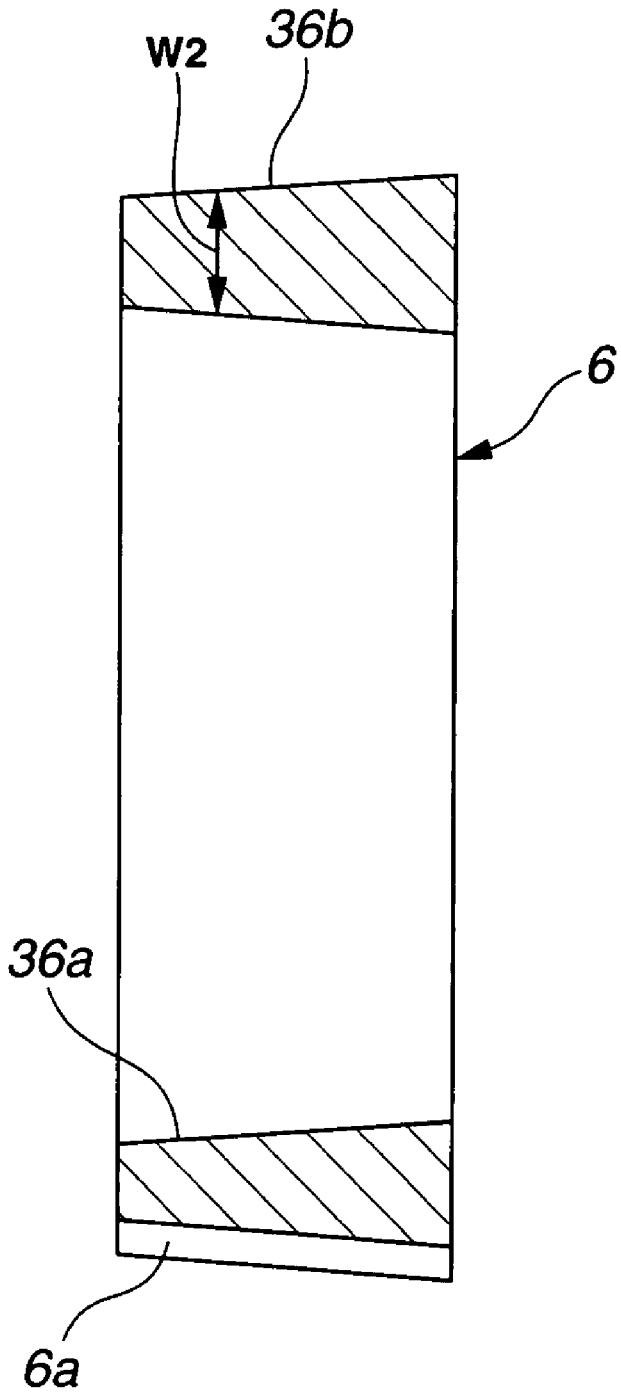
FIG. 8 is a side sectional view of the cam ring according to the fourth embodiment taken along a plane indicated by the line VIII-VIII in FIG. 7.

The following describes a variable displacement vane pump according to a fourth embodiment of the present invention with reference to FIGS. 7 and 8. The fourth embodiment is constructed based on the first embodiment, and different from the first embodiment in that the inner and outer radial peripheries of cam ring 6 are tapered linearly when followed along its longitudinal axis.

Specifically, as shown in FIG. 8, a radial thickness W2 is defined as a radial thickness of cam ring 6. Radial thickness W2 gradually and linearly increases when followed longitudinally of cam ring 6 from one longitudinal end to the other longitudinal end. The inner radial periphery of cam ring 6 is implemented by an inner inclined surface 36*a*, while the outer radial periphery of cam ring 6 is implemented by an outer inclined surface 36*b*. When adapter ring 5 is formed by sintering, the inner and outer radial peripheries of adapter ring 5 are actually inclined to make it easy to draw adapter ring 5 from the sintering mold. The inclination of inner and outer inclined surfaces 36*a* and 36*b* are set substantially equal to that of the inner and outer radial peripheries of adapter ring 5. Adapter ring 5 and cam ring 6 are mounted in such a manner that the direction of tapering of adapter ring 5 is opposite to that of cam ring 6 so that the tapering of adapter ring 5 and the tapering of cam ring 6 are suitably cancelled by each other. That is, one of adapter ring 5 and cam ring 6 has a radial thickness that gradually increases when followed longitudinally from pressure plate 8 toward rear body 3, while the other of adapter ring 5 and cam ring 6 has a radial thickness that gradually decreases when followed longitudinally from pressure plate 8 toward rear body 3.

The outer radial periphery of cam ring 6 includes a positioning groove 6*a* which extends longitudinally of cam ring 6 with a semicircle-shaped cross-section, and is fitted to the upper portion of positioning pin 9. Outer inclined surface 36*b* is formed to extend circumferentially all around the whole outer radial periphery of cam ring 6 except positioning groove 6*a*.

According to the fourth embodiment, even when the inner and outer radial peripheries of adapter ring 5 are provided with a relatively large inclination for making it easy to draw adapter ring 5 from the sintering mold, the inclination of the inner and outer radial peripheries of adapter ring 5 can be cancelled by the provision of inner and outer inclined surfaces 36*a* and 36*b* as appropriate. This is effective for improving the operation of variable displacement vane pump 1 especially under condition that the pump discharge pressure is low.

Figure 9:
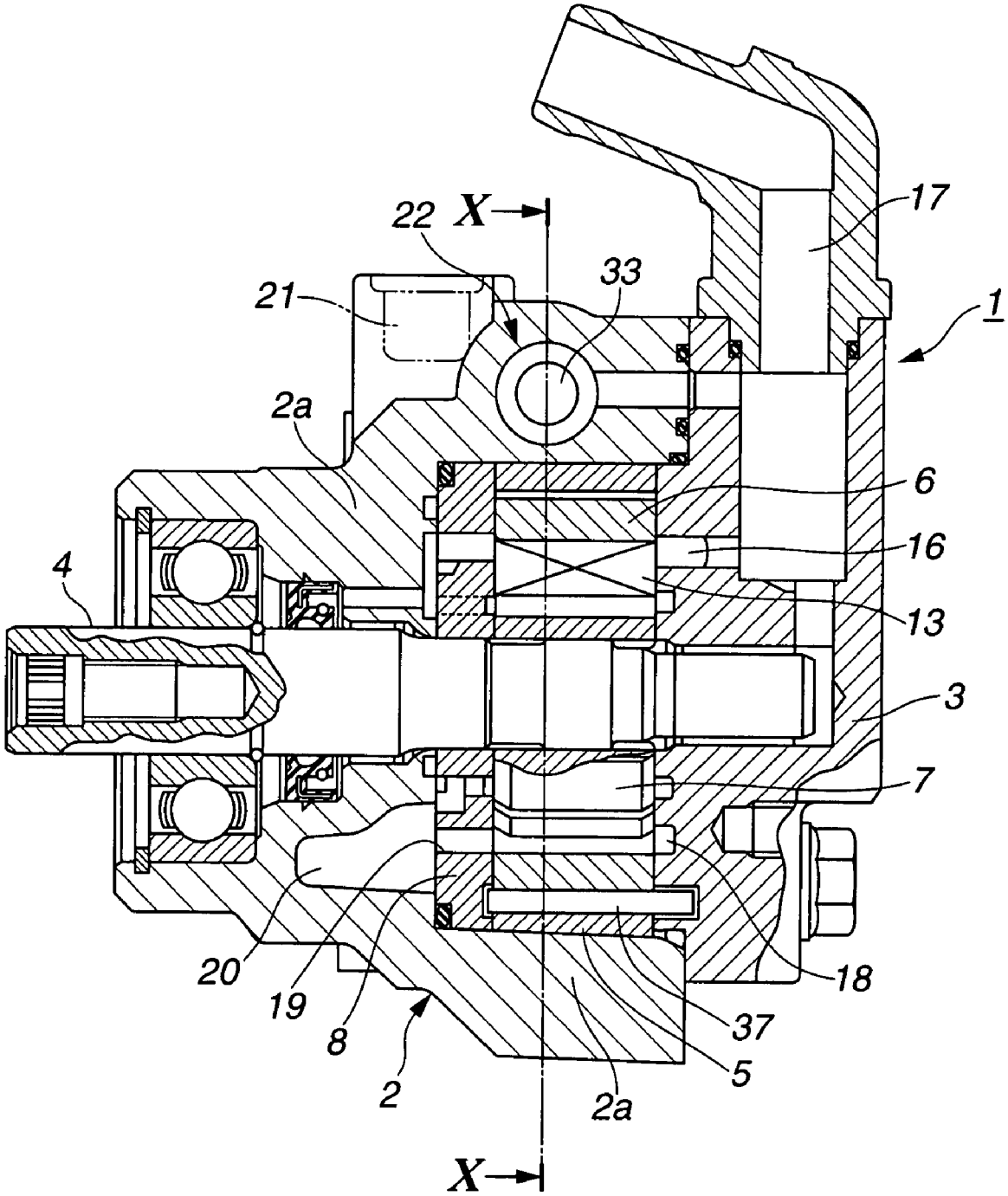
FIG. 9 is a side sectional view of a variable displacement vane pump according to a fifth embodiment of the present invention taken along a plane in which a drive shaft has a longitudinal axis.
Figure 10:
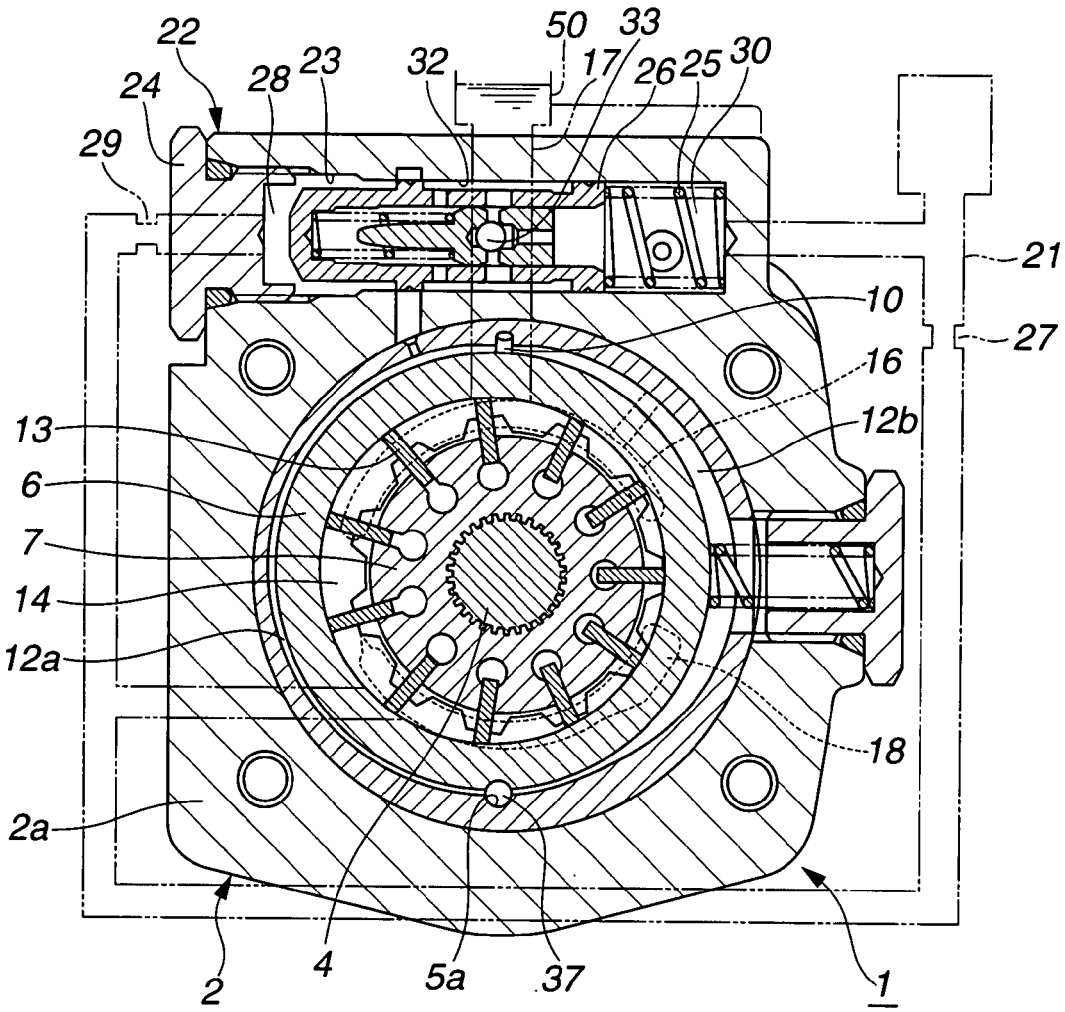
FIG. 10 is a cross-sectional view of the variable displacement vane pump according to the fifth embodiment taken along a plane indicated by the line X-X in FIG. 9.
Figure 11:
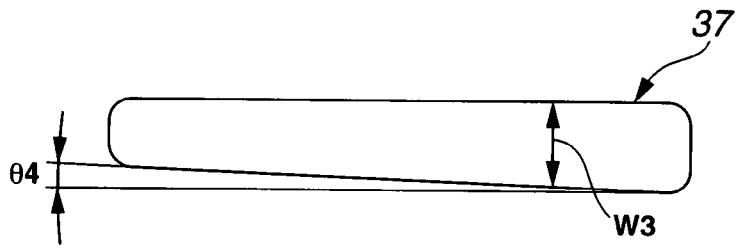
FIG. 11 is a side view of a pin of the variable displacement vane pump according to the fifth embodiment.

The following describes a variable displacement vane pump according to a fifth embodiment of the present invention with reference to FIGS. 9 to 11. The fifth embodiment is constructed based on the first embodiment, and different from the first embodiment in that adapter ring 5 includes no pivoting contact area 11, and positioning pin 9 is replaced by a pivot pin 37 which is disposed at the inner radial periphery of adapter ring 5 and has a longitudinal axis extending longitudinally of adapter ring 5 to serve as a cam ring support member to pivot the cam ring 6.

As shown in FIG. 11, pivot pin 37 is a tapered pin. An outer diameter W3 of pivot pin 37 increases gradually and linearly when followed longitudinally of pivot pin 37 from the longitudinal end facing the pressure plate 8 to the longitudinal end facing the rear body 3. The outer radial periphery of pivot pin 37 is tapered at an angle of taper θ4. The angle of taper θ4 is equal to about 0.04°.

When cylinder portion 2*a* of front body 2 is elastically deformed by the pump discharge pressure, the deformation of cylinder portion 2*a* is cancelled by the tapering of pivot pin 37. Naturally, it is unnecessary to adjust the radial thickness of adapter ring 5 as in the first embodiment.

The fifth embodiment may be modified as follows. Pivot pin 37 is formed with no angle of taper θ4. On the other hand, the inner radial periphery of pin-retaining groove 5*a* of adapter ring 5 is tapered along the longitudinal direction of adapter ring 5 so that the depth of pin-retaining groove 5*a* increases gradually and linearly when followed toward pressure plate 8. In other words, a portion of adapter ring 5 in contact with pin 37 has a radial thickness that gradually increases when followed longitudinally of adapter ring 5 from pressure plate 8 toward rear body 3. The shape of pin-retaining groove 5*a* according to this modification can be easily formed, because adapter ring 5 is formed by sintering. Pivot pin 37 can be also easily formed, because pivot pin 37 has no tapered portion.

Figure 12:
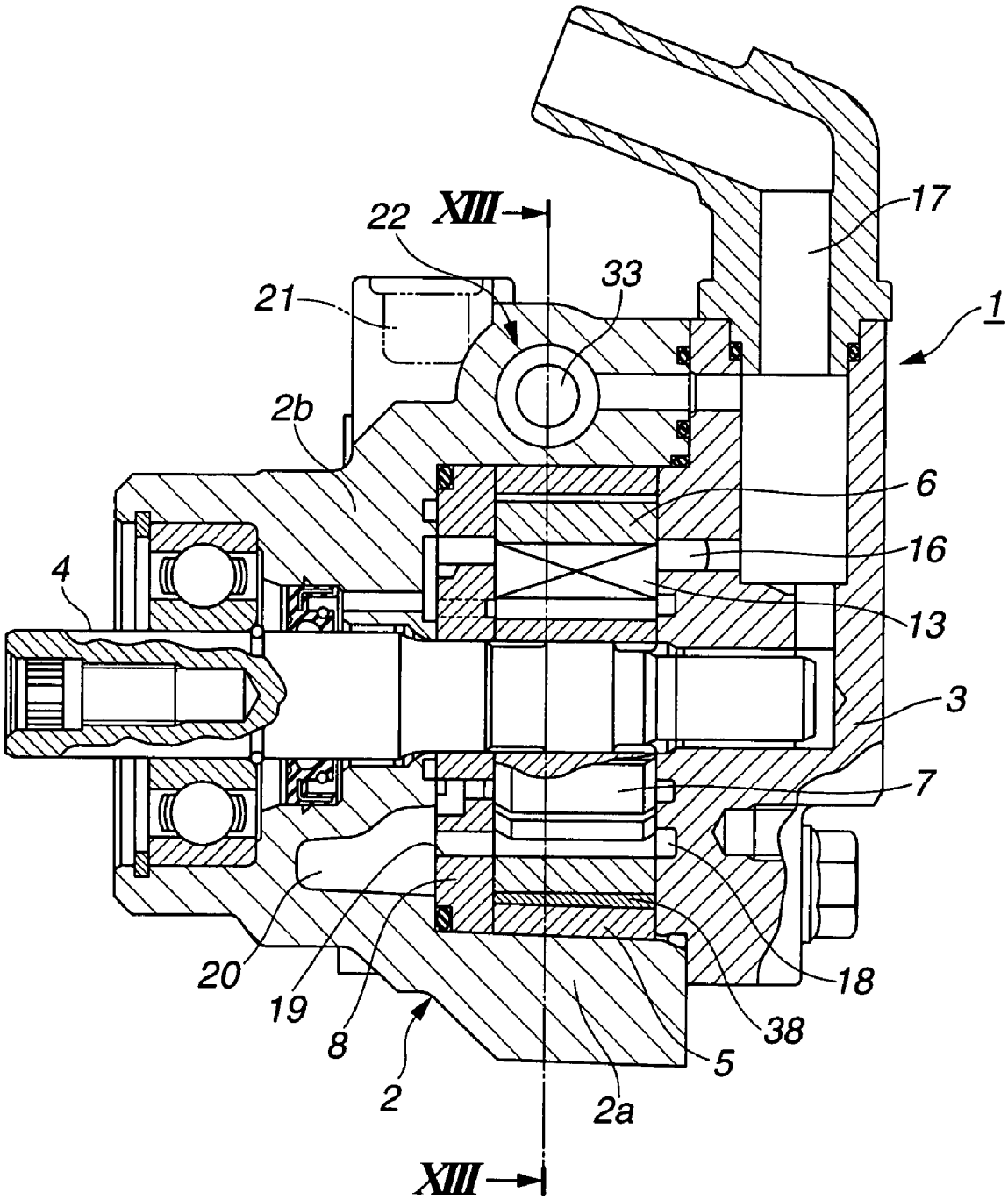
FIG. 12 is a side sectional view of a variable displacement vane pump according to a sixth embodiment of the present invention taken along a plane in which a drive shaft has a longitudinal axis.
Figure 13:
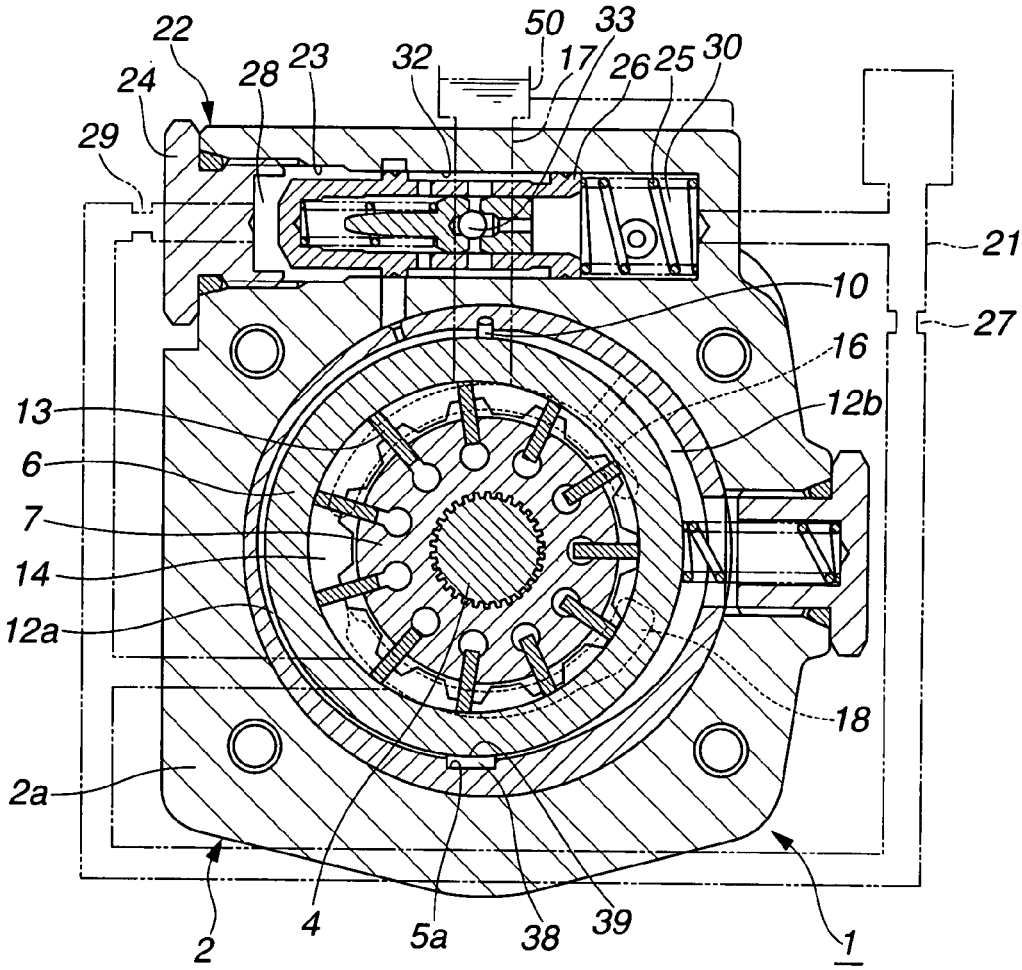
FIG. 13 is a cross-sectional view of the variable displacement vane pump according to the sixth embodiment taken along a plane indicated by the line XIII-XIII in FIG. 12.
Figure 14:
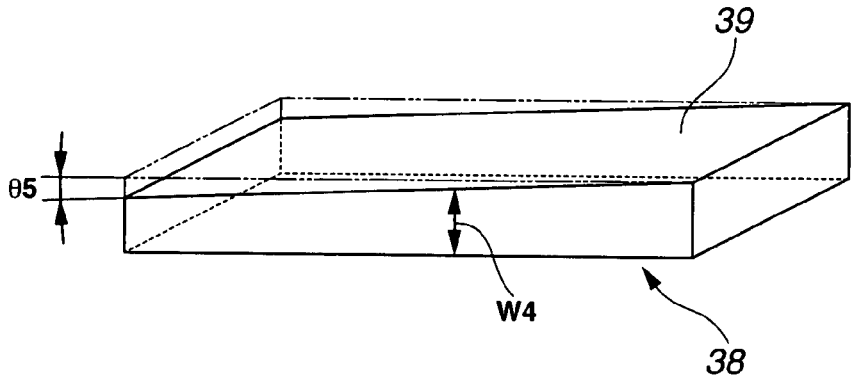
FIG. 14 is a perspective view of a plate of the variable displacement vane pump according to the sixth embodiment.

The following describes a variable displacement vane pump according to a sixth embodiment of the present invention with reference to FIGS. 12 to 14. The sixth embodiment is constructed based on the fifth embodiment, and different from the fifth embodiment in that pin-retaining groove 5*a* of adapter ring 5 has a rectangular cross-section, and pivot pin 37 is replaced by a plate 38 which serves as a cam ring support member to pivot cam ring 6. Plate 38 is a substantially rectangular plate made of metal, having a longitudinal axis extending longitudinally of adapter ring 5.

Plate 38 may be identical to vane 13. As shown in FIG. 14, the thickness W4 of plate 38 increases gradually and linearly when followed longitudinally of plate 38 from pressure plate 8 toward rear body 3. That is, the upper surface of plate 38 is implemented by an inclined surface 39 which is inclined toward pressure plate 8. The angle of inclination θ5 of inclined surface 39 is equal to about 0.08°.

The tapered shape of plate 38 may be implemented by a combination of no inclined surface 39 at the top of plate 38 and an inclined surface at the bottom of plate 38. Alternatively, the tapered shape of plate 38 may be implemented by a combination of inclined surface 39 at the top of plate 38 and an inclined surface at the bottom of plate 38. In case of the combination of inclined surface 39 at the top of plate 38 and the inclined surface at the bottom of plate 38, the inclination of the two inclined surfaces are set in such a manner that when adapter ring 5 is inclined toward rear body 3 at 0.08° due to the discharge pressure, the upper surface of plate 38 is substantially parallel to the longitudinal axis of drive shaft 4.

According to the sixth embodiment, the tapered shape of plate 38 is effective for producing similar advantageous effects as in the fifth embodiment, and further effective even when the pump discharge pressure is high, because plate 38 is solider so as to solidly support cam ring 6.

The sixth embodiment may be modified as follows. The upper and lower lateral surfaces of plate 38 are set to be parallel to each other. On the other hand, the bottom face of pin-retaining groove 5*a* of adapter ring 5 is implemented by an inclined surface which declines gradually and linearly when followed longitudinally of adapter ring 5 from rear body 3 toward pressure plate 8. In other words, a portion of adapter ring 5 in contact with plate 38 has a radial thickness that gradually increases when followed longitudinally of adapter ring 5 from pressure plate 8 toward rear body 3. According to this modification, plate 38 can be easily formed, because it is unnecessary to form an inclined surface in plate 38.

The shape of inclined surface 39 of plate 38 may be modified similarly as pivoting contact area 11 of adapter ring 5 in the third embodiment. Specifically, inclined surface 39 may formed in such a manner that the angle of inclination θ5 of inclined surface 39 increases gradually and linearly when followed circumferentially of adapter ring 5 from the circumferential end facing the second fluid pressure chamber 12*b* toward the circumferential end facing the first fluid pressure chamber 12*a*. This modification is effective as in the third embodiment.

The variable displacement vane pump described above may be modified by adjusting the shape and size of front body 2 and rear body 3, and the shape and construction of control valve 22 in accordance with given requirements and applications.

This application is based on a prior Japanese Patent Application No. 2006-297273 filed on Nov. 1, 2006. The entire contents of this Japanese Patent Application No. 2006-297273 are hereby incorporated by reference.

Although the invention has been described above by reference to certain embodiments of the invention, the invention is not limited to the embodiments described above. Modifications and variations of the embodiments described above will occur to those skilled in the art in light of the above teachings. The scope of the invention is defined with reference to the following claims.

What is claimed is:

1. A variable displacement vane pump comprising:

a first body including:

a cylinder portion having an inner space extending longitudinally therethrough; and a base portion covering a first longitudinal end of the inner space of the cylinder portion;

a second body covering a second longitudinal end of the inner space of the first body;

a drive shaft supported by the first body and the second body for rotation, the drive shaft having a longitudinal axis extending in the inner space of the first body longitudinally of the cylinder portion of the first body;

an adapter ring having an outer radial periphery fitted and fixed to an inner radial periphery of the cylinder portion of the first body, and having an inner radial periphery including a contact area;

a cam ring mounted inside the adapter ring and supported by the adapter ring for lateral motion in contact with the contact area of the adapter ring, the cam ring and the adapter ring defining first and second fluid pressure chambers therebetween, the first fluid pressure chamber having a volumetric capacity that increases when the cam ring moves toward a first end position, the second fluid pressure chamber having a volumetric capacity that increases when the cam ring moves toward a second end position;

a rotor mounted inside the cam ring and coupled to the drive shaft at least for rotation about an axis in a direction, the rotor defining an annular chamber outside thereof, the rotor including a plurality of slots arranged circumferentially at its outer radial periphery, each of the slots extending radially of the rotor;

a plurality of vanes mounted in respective ones of the slots of the rotor for moving longitudinally of the slots of the rotor, the vanes extending radially of the rotor and dividing the annular chamber into a plurality of pump chambers;

a suction port defined in a first section of the annular chamber in which each of the pump chambers expands with the rotation of the rotor; and a discharge port defined in a second section of the annular chamber in which each of the pump chambers contracts with the rotation of the rotor, the discharge port defining a third section of the annular chamber from the suction port to the discharge port along the direction of rotation of the rotor, the third section having a larger volumetric capacity when the cam ring is in the second end position than when the cam ring is in the first end position, wherein the adapter ring has at least in the contact area a radial thickness that gradually increases when followed longitudinally of the adapter ring from the base portion of the first body toward the second body.

2. The variable displacement vane pump as claimed in claim 1, further comprising:

a pressure plate disposed between the base portion of the first body and the adapter ring; and a seal disposed radially outside of the cam ring, the seal defining the first and second fluid pressure chambers on both sides thereof.

3. The variable displacement vane pump as claimed in claim 1, wherein the cam ring has an outer radial periphery extending substantially parallel to the longitudinal axis of the drive shaft.

4. The variable displacement vane pump as claimed in claim 3, wherein the cam ring is formed by cutting.

5. The variable displacement vane pump as claimed in claim 1, wherein the adapter ring is formed by sintering.

6. The variable displacement vane pump as claimed in claim 1, wherein:

the adapter ring has only in the contact area a radial thickness that gradually increases when followed longitudinally of the adapter ring from the base portion of the first body toward the second body; and the adapter ring has except in the contact area a radial thickness that is substantially constant when followed longitudinally of the adapter ring from the base portion of the first body toward the second body.

7. The variable displacement vane pump as claimed in claim 1, wherein the radial thickness in the contact area of the adapter ring gradually varies when followed circumferentially of the adapter ring.

8. The variable displacement vane pump as claimed in claim 7, wherein:

the radial thickness in the contact area of the adapter ring gradually increases when followed circumferentially of the adapter ring from a first portion of the contact area to a second portion of the contact area; and the cam ring is in contact with the first portion of the contact area when the cam ring is in the first end position, and is in contact with the second portion of the contact area when the cam ring is in the second end position.

9. A variable displacement vane pump comprising:

a first body including:

a cylinder portion having an inner space extending longitudinally therethrough; and a base portion covering a first longitudinal end of the inner space of the cylinder portion;

a second body covering a second longitudinal end of the inner space of the first body;

a drive shaft supported by the first body and the second body for rotation, the drive shaft having a longitudinal axis extending in the inner space of the first body longitudinally of the cylinder portion of the first body;

an adapter ring having an outer radial periphery fitted and fixed to an inner radial periphery of the cylinder portion of the first body;

a cam ring support member disposed at an inner radial periphery of the adapter ring;

a cam ring mounted inside the adapter ring and supported by the cam ring support member for lateral motion in contact with the cam ring support member, the cam ring and the adapter ring defining first and second fluid pressure chambers therebetween, the first fluid pressure chamber having a volumetric capacity that increases when the cam ring moves toward a first end position, the second fluid pressure chamber having a volumetric capacity that increases when the cam ring moves toward a second end position;

a rotor mounted inside the cam ring and coupled to the drive shaft at least for rotation about an axis in a direction, the rotor defining an annular chamber outside thereof, the rotor including a plurality of slots arranged circumferentially at its outer radial periphery, each of the slots extending radially of the rotor;

a plurality of vanes mounted in respective ones of the slots of the rotor for moving longitudinally of the slots of the rotor, the vanes extending radially of the rotor and dividing the annular chamber into a plurality of pump chambers;

a suction port defined in a first section of the annular chamber in which each of the pump chambers expands with the rotation of the rotor; and a discharge port defined in a second section of the annular chamber in which each of the pump chambers contracts with the rotation of the rotor, the discharge port defining a third section of the annular chamber from the suction port to the discharge port along the direction of rotation of the rotor, the third section having a larger volumetric capacity when the cam ring is in the second end position than when the cam ring is in the first end position, wherein the cam ring support member has a thickness radially of the drive shaft that gradually increases when followed longitudinally of the drive shaft from the base portion of the first body toward the second body.

10. The variable displacement vane pump as claimed in claim 9, wherein the cam ring support member is a pivot pin having a longitudinal axis extending longitudinally of the adapter ring.

11. The variable displacement vane pump as claimed in claim 10, wherein the pivot pin has an outer diameter that gradually increases when followed longitudinally of the pivot pin from the base portion of the first body toward the second body.

12. The variable displacement vane pump as claimed in claim 10, wherein a portion of the adapter ring in contact with the pivot pin has a radial thickness that gradually increases when followed longitudinally of the adapter ring from the base portion of the first body toward the second body.

13. The variable displacement vane pump as claimed in claim 9, wherein the cam ring support member is a substantially rectangular plate made of metal, the substantially rectangular plate having a longitudinal axis extending longitudinally of the adapter ring.

14. The variable displacement vane pump as claimed in claim 13, wherein the substantially rectangular plate has a thickness radially of the drive shaft that gradually increases when followed longitudinally of the substantially rectangular plate from the base portion of the first body toward the second body.

15. The variable displacement vane pump as claimed in claim 13, wherein a portion of the adapter ring in contact with the substantially rectangular plate has a radial thickness that gradually increases when followed longitudinally of the adapter ring from the base portion of the first body toward the second body.

16. A variable displacement vane pump comprising:

a first body including:

a cylinder portion having an inner space extending longitudinally therethrough; and a base portion covering a first longitudinal end of the inner space of the cylinder portion;

a second body covering a second longitudinal end of the inner space of the first body;

a drive shaft supported by the first body and the second body for rotation, the drive shaft having a longitudinal axis extending in the inner space of the first body longitudinally of the cylinder portion of the first body;

an adapter ring having an outer radial periphery fitted and fixed to an inner radial periphery of the cylinder portion of the first body, and having an inner radial periphery including a contact area;

a cam ring mounted inside the adapter ring and supported by the adapter ring for lateral motion in contact with the contact area of the adapter ring, the cam ring and the adapter ring defining first and second fluid pressure chambers therebetween, the first fluid pressure chamber having a volumetric capacity that increases when the cam ring moves toward a first end position, the second fluid pressure chamber having a volumetric capacity that increases when the cam ring moves toward a second end position;

a rotor mounted inside the cam ring and coupled to the drive shaft at least for rotation about an axis in a direction, the rotor defining an annular chamber outside thereof, the rotor including a plurality of slots arranged circumferentially at its outer radial periphery, each of the slots extending radially of the rotor;

a plurality of vanes mounted in respective ones of the slots of the rotor for moving longitudinally of the slots of the rotor, the vanes extending radially of the rotor and dividing the annular chamber into a plurality of pump chambers;

a suction port defined in a first section of the annular chamber in which each of the pump chambers expands with the rotation of the rotor; and a discharge port defined in a second section of the annular chamber in which each of the pump chambers contracts with the rotation of the rotor, the discharge port defining a third section of the annular chamber from the suction port to the discharge port along the direction of rotation of the rotor, the third section having a larger volumetric capacity when the cam ring is in the second end position than when the cam ring is in the first end position, wherein at least one of the adapter ring and the cam ring has a radial thickness that when followed longitudinally from the base portion of the first body toward the second body, varies in such a manner that when the cylinder portion of the first body is deformed radially outside due to internal pressures of the pump chambers, the cam ring has a surface at its inner radial periphery, the surface facing the discharge port radially of the cam ring and extending substantially parallel to the longitudinal axis of the drive shaft.

17. The variable displacement vane pump as claimed in claim 16, wherein the cam ring has a radial thickness that gradually increases when followed longitudinally of the cam ring from the base portion of the first body toward the second body.

18. The variable displacement vane pump as claimed in claim 16, wherein:

one of the adapter ring and the cam ring has a radial thickness that gradually increases when followed longitudinally from the base portion of the first body toward the second body; and the other of the adapter ring and the cam ring has a radial thickness that gradually decreases when followed longitudinally from the base portion of the first body toward the second body.

19. A method of manufacturing a variable displacement vane pump comprising:

a first body including:

a cylinder portion having an inner space extending longitudinally therethrough; and a base portion covering a first longitudinal end of the inner space of the cylinder portion;

a second body covering a second longitudinal end of the inner space of the first body;

a drive shaft supported by the first body and the second body for rotation, the drive shaft having a longitudinal axis extending in the inner space of the first body longitudinally of the cylinder portion of the first body;

an adapter ring having an outer radial periphery fitted and fixed to an inner radial periphery of the cylinder portion of the first body, and having an inner radial periphery including a contact area;

a cam ring mounted inside the adapter ring and supported by the adapter ring for lateral motion in contact with the contact area of the adapter ring, the cam ring and the adapter ring defining first and second fluid pressure chambers therebetween, the first fluid pressure chamber having a volumetric capacity that increases when the cam ring moves toward a first end position, the second fluid pressure chamber having a volumetric capacity that increases when the cam ring moves toward a second end position;

a rotor mounted inside the cam ring and coupled to the drive shaft at least for rotation about an axis in a direction, the rotor defining an annular chamber outside thereof, the rotor including a plurality of slots arranged circumferentially at its outer radial periphery, each of the slots extending radially of the rotor;

a plurality of vanes mounted in respective ones of the slots of the rotor for moving longitudinally of the slots of the rotor, the vanes extending radially of the rotor and dividing the annular chamber into a plurality of pump chambers;

a suction port defined in a first section of the annular chamber in which each of the pump chambers expands with the rotation of the rotor; and a discharge port defined in a second section of the annular chamber in which each of the pump chambers contracts with the rotation of the rotor, the discharge port defining a third section of the annular chamber from the suction port to the discharge port along the direction of rotation of the rotor, the third section having a larger volumetric capacity when the cam ring is in the second end position than when the cam ring is in the first end position, the method comprising:

forming the adapter ring in such a manner that the adapter ring includes a tapered portion having a radial thickness that gradually increases when followed longitudinally from a first longitudinal end of the adapter ring to a second longitudinal end of the adapter ring;

mounting the adapter ring inside the cylinder portion of the first body in such a manner that the first longitudinal end of the adapter ring faces the base portion of the first body;

mounting the drive shaft, the cam ring, and the rotor with the vanes inside the cylinder portion of the first body in such a manner that the tapered portion of the adapter ring radially faces the second section of the annular and attaching the second body to the first body in such a manner to cover the second longitudinal end of the inner space of the first body. chamber through the cam ring;

20. The method of manufacturing the variable displacement vane pump as claimed in claim 19, wherein the forming the adapter ring is implemented by forming the adapter ring by sintering.

21. The method of manufacturing the variable displacement vane pump as claimed in claim 20, further comprising: forming the cam ring by cutting.

22. The method of manufacturing the variable displacement vane pump as claimed in claim 20, further comprising:

forming the cam ring in such a manner that the cam ring includes a tapered portion having a radial thickness that gradually increases when followed longitudinally from a first longitudinal end of the cam ring to a second longitudinal end of the cam ring; and mounting the cam ring inside the adapter ring in such a manner that the tapered portion of the cam ring radially faces the tapered portion of the adapter ring and the second longitudinal end of the cam ring faces the base portion of the first body.

* * * * *